US011299829B2

(12) United States Patent
Meir

(10) Patent No.: US 11,299,829 B2
(45) Date of Patent: Apr. 12, 2022

(54) KNITTING MACHINE WITH ADJUSTABLE NEEDLE BEDS AND VARIABLE THICKNESS KNITTED COMPONENT

(71) Applicant: NIKE, Inc., Beaverton, OR (US)

(72) Inventor: Adrian Meir, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 26 days.

(21) Appl. No.: 16/702,898

(22) Filed: Dec. 4, 2019

(65) Prior Publication Data

US 2020/0181813 A1 Jun. 11, 2020

Related U.S. Application Data

(60) Provisional application No. 62/777,556, filed on Dec. 10, 2018.

(51) Int. Cl.

| | |
|---|---|
| ***D04B 1/22*** | (2006.01) |
| ***D04B 1/12*** | (2006.01) |
| ***D04B 7/14*** | (2006.01) |
| *A43B 23/02* | (2006.01) |

(52) U.S. Cl.

CPC ..... *D04B 1/22* (2013.01); *D04B 1/123* (2013.01); *D04B 7/14* (2013.01); *A43B 23/025* (2013.01); *D10B 2403/032* (2013.01); *D10B 2501/043* (2013.01)

(58) Field of Classification Search

CPC ... D04B 1/22; D04B 7/04; D04B 7/14; D04B 7/30; D04B 15/96; D04B 1/10; D04B 1/102

See application file for complete search history.

(56) References Cited

U.S. PATENT DOCUMENTS

| | | | | |
|---|---|---|---|---|
| 4,332,149 | A | 6/1982 | Mayer | |
| 5,807,295 | A * | 9/1998 | Hutcheon | A61F 5/01 602/42 |
| 6,156,406 | A * | 12/2000 | Rock | B32B 5/12 428/86 |
| 7,213,421 | B2 * | 5/2007 | Shirasaki | D04B 21/14 66/193 |
| 7,235,504 | B2 * | 6/2007 | Shirasaki | A47C 31/006 442/304 |

(Continued)

FOREIGN PATENT DOCUMENTS

| | | | |
|---|---|---|---|
| CH | 386 605 | A | 1/1965 |
| CN | 102978823 | A | 3/2013 |

(Continued)

OTHER PUBLICATIONS

International Search Report and Written Opinion of the International Searching Authority for PCT/US2019/064415 dated Apr. 9, 2020; 19 pages.

(Continued)

*Primary Examiner* — Danny Worrell

(74) *Attorney, Agent, or Firm* — Shook, Hardy & Bacon L.L.P.

(57) ABSTRACT

A variable thickness knitted component including a first region having a spacer knit construction, the first region having a first thickness, and a second region having the spacer knit construction, the second region having a second thickness different than the first thickness. The knitted component may be an integral one-piece element.

17 Claims, 13 Drawing Sheets

(56) References Cited

U.S. PATENT DOCUMENTS

| | | | | |
|---|---|---|---|---|
| 7,380,420 | B1 * | 6/2008 | Liu | D04B 21/18 66/195 |
| 7,380,421 | B1 * | 6/2008 | Liu | D04B 21/14 66/196 |
| 7,565,821 | B2 * | 7/2009 | Park | B60N 2/976 66/195 |
| 7,913,520 | B1 * | 3/2011 | Chen | D04B 1/16 66/196 |
| 8,491,514 | B2 * | 7/2013 | Creighton | A61F 13/10 602/60 |
| 8,522,577 | B2 | 9/2013 | Huffa | |
| 9,060,570 | B2 | 6/2015 | Huffa et al. | |
| 10,945,482 | B2 * | 3/2021 | Schoppel | D04B 1/102 |
| 2013/0266773 | A1 * | 10/2013 | Hazenberg | A43B 13/20 428/188 |
| 2015/0376823 | A1 * | 12/2015 | Daube | D04B 23/00 66/195 |
| 2016/0289872 | A1 * | 10/2016 | Kieren | D04B 21/20 |
| 2018/0338563 | A1 * | 11/2018 | Moretti Polegato | D04B 21/20 |
| 2020/0085121 | A1 * | 3/2020 | Morganti | D04B 21/16 |
| 2020/0181813 | A1 * | 6/2020 | Meir | D04B 15/96 |
| 2020/0340152 | A1 * | 10/2020 | Mueller | D04B 21/04 |
| 2020/0354867 | A1 * | 11/2020 | Mueller | B68G 7/02 |

FOREIGN PATENT DOCUMENTS

| | | | |
|---|---|---|---|
| DE | 42 07 414 | A1 | 10/1992 |
| DE | 41 40 826 | A1 | 6/1993 |
| EP | 1 647 619 | A1 | 4/2006 |
| EP | 2 530 195 | A1 | 12/2012 |
| EP | 3 186 423 | A1 | 7/2017 |
| EP | 3 251 641 | A1 | 12/2017 |
| WO | WO 90/07601 | A1 | 7/1990 |

OTHER PUBLICATIONS

International Preliminary Report on Pantentability received for PCT Patent Application No. PCT/US2019/064415, dated Jun. 24, 2021, 12 pages.

* cited by examiner

KNITTING MACHINE WITH ADJUSTABLE NEEDLE BEDS AND VARIABLE THICKNESS KNITTED COMPONENT

RELATED APPLICATION

This application claims the benefit of U.S. Provisional Application No. 62/777,556, filed on Dec. 10, 2018, the entirety of which is incorporated herein by reference.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Knitting is an example of a process that may form a textile. Knitting may generally be classified as either weft knitting or warp knitting. In both weft knitting and warp knitting, one or more yarns are manipulated to form a plurality of intermeshed loops that define a variety of courses and wales. In weft knitting, which is more common, the courses and wales are perpendicular to each other and may be formed from a single yarn or many yarns. In warp knitting, the wales and courses run roughly parallel.

Although knitting may be performed by hand, the commercial manufacture of knitted components is generally performed by knitting machines. An example of a knitting machine for producing a weft knitted component is a V-bed flat knitting machine, which includes two needle beds that are angled with respect to each other. Rails extend above and parallel to the needle beds and provide attachment points for feeders, which move along the needle beds and supply yarns to needles within the needle beds. Standard feeders have the ability to supply a yarn that is utilized to knit, tuck, and float. In situations where an inlay yarn is incorporated into a knitted component, an inlay feeder is typically utilized.

One application of a conventional V-bed flat knitting machine is the manufacture of so-called "spacer knit fabrics" consisting of two separate fabric layers, with one or more yarns or monofilaments extending therebetween, the monofilament interlock with the two fabric layers. Some advantages of spacer knit fabrics include breathability, energy absorption, compression strength, insulation, pressure distribution, good dispersion of moisture, etc., some or all of which may be desirable in various articles formed from textiles, including for example, an upper for an article of footwear. Depending on the materials selected to form the separate fabric layers, and the yarns or monofilaments extending therebetween, these and other characteristics may be realized or enhanced.

One advantage of forming a knitted component having a spacer knit construction on a conventional V-bed flat knitting machine is that one of the fabric layers of the spacer knit construction may be formed on one needle bed, while the other fabric layer is simultaneously formed on the other needle bed. Furthermore, as the layers are being formed, the one or more yarns or monofilaments extending between the two fabric layers may be knitted or tucked to interlock with the opposing layers. In this way, a knitted component including a spacer knit construction may be formed on a conventional V-bed flat knitting machine as an integral one-piece element from a single knitting process, thereby reducing or substantially eliminating significant post-knitting process or steps, and inefficiencies stemming from such post-knitting processes or steps.

However, a limitation of forming a knitted component including a spacer knit construction on a conventional V-bed flat knitting machine is that the spacing between the two needle beds is relatively small and fixed. The spacing between the two layers of fabric of a spacer knit construction formed on a conventional V-bed flat knitting machine is therefore limited by the relatively small, fixed spacing between the needle beds. Consequently, spacer knit fabrics formed on a conventional V-bed flat knitting machine generally have a substantially uniform thickness, thereby limiting various characteristics of the spacer knit fabric, such as its thickness and the volume of the one or more yarns or monofilaments extending between its two layers. In this way, the various applications and aesthetic appearances of knitted components including a spacer knit construction formed on a conventional V-bed flat knitting machine are also limited.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure.

DETAILED DESCRIPTION

Figure 1:
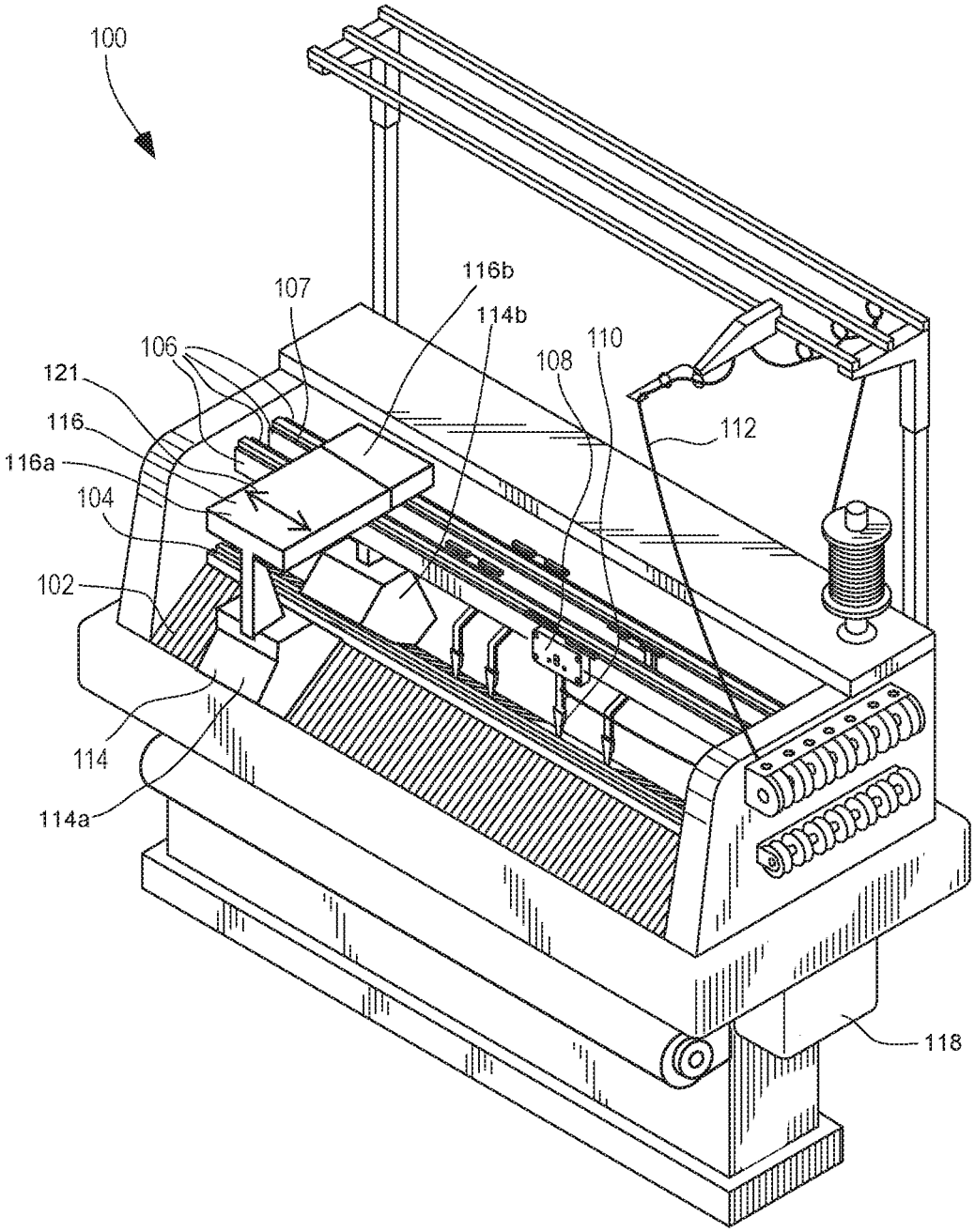
FIG. 1 is an illustration showing a perspective view of a knitting machine in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Knitting Machine Embodiments

Figure 2:
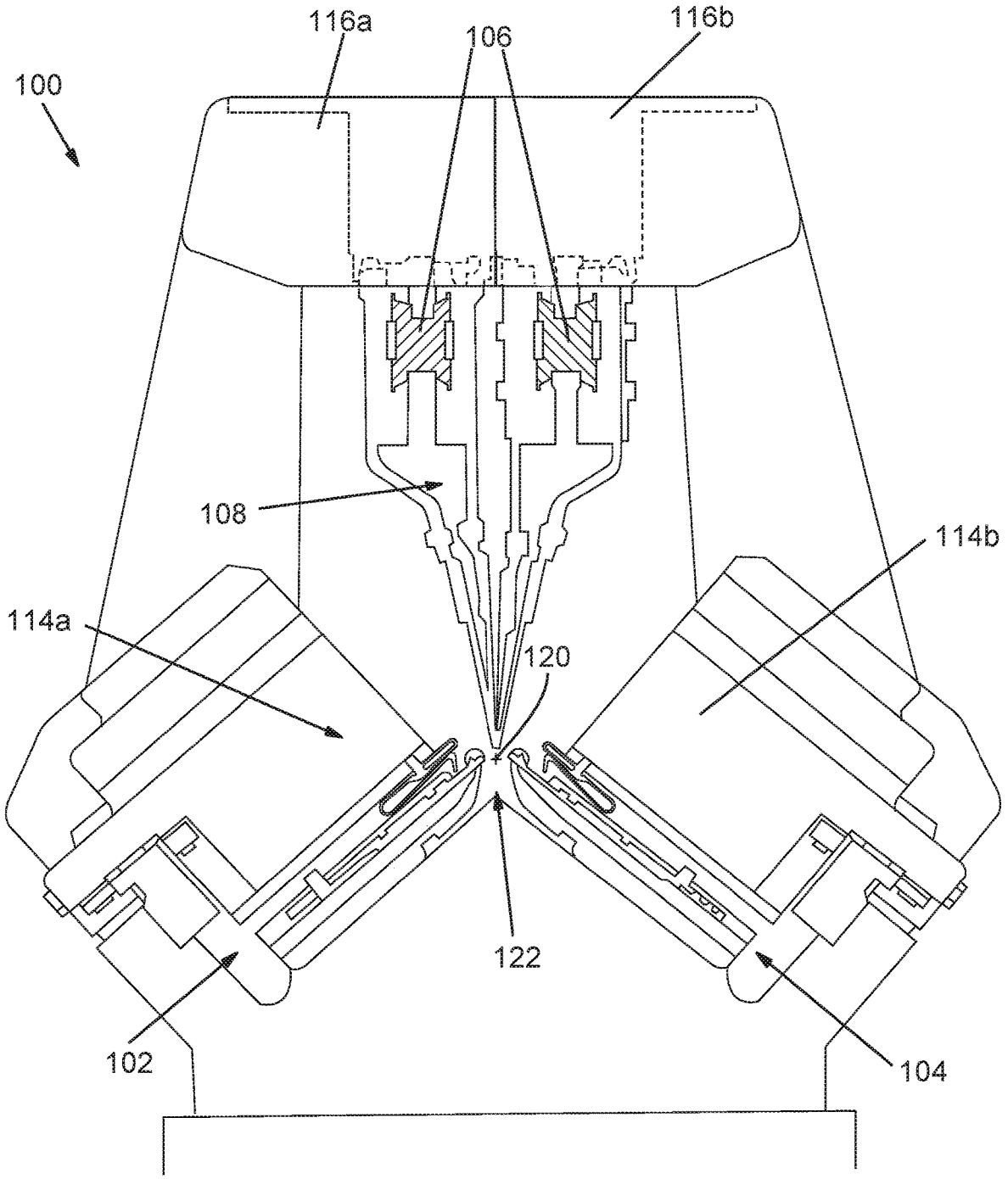
FIG. 2 is a schematic section view of the knitting machine of FIG. 1.

Referring initially to FIGS. 1-2, a knitting machine 100 is illustrated according to an exemplary embodiment of the present disclosure. Knitting machine 100 can be of any suitable type, such as a flat knitting machine, a circular knitting machine, or other type. For example, knitting machine 100 of FIG. 1 has a configuration of a V-bed flat knitting machine as an exemplary embodiment. However, the knitting machine 100 can have different configurations without departing from the scope of the present disclosure.

FIGS. 1-2 show a knitting machine 100 with two needle beds (a front or first needle bed 102 and a back or second needle bed 104) that are angled with respect to each other (e.g., thereby forming a V-bed). The needles 101 of the first needle bed 102 may lay on a first plane, and the needles 101 of the second needle bed 104 may lay on a second plane. The first plane and the second plane may be angled relative to each other and meet to form an intersection 120 (or axis) that extends along a majority of a width of the knitting machine 100. The first needle bed 102 and the second needle bed 104 may be spaced apart relative to each other to define a gap 122, as shown in FIGS. 1-2. The needles, needle beds, and intersection are further described below, and in additional detail in U.S. patent application Ser. No. 13/048,540, patented as U.S. Pat. No. 9,060,570, which is herein incorporated by reference in its entirety.

One or more rails 106 may extend above and parallel to the intersection and may provide attachment points for one or more feeders 108. Herein, the rails 106 are defined by a track for which a feeder 108 may couple to in a movable manner. The rails 106 may be secured to a body 107, where the body 107 includes a rail 106 on each side (e.g., on two sides as shown) (and where each of the rails 106 are configured to couple to one or more feeders 108). Two rails 106 are included in the depicted embodiment, but more or fewer than two rails 106 may be included. The feeders 108 may include a dispensing area 110 located near the intersection 120 and configured to dispense a yarn 112 to at least one of the first needle bed 102 and the second needle bed 104 as it moves along the intersection 120. It will be appreciated that feeders 108 can be configured to feed any type of yarn, fiber, wire, cable, filament, or other strand toward the needles. As used in this application, a yarn may include a strand (e.g., a monofilament strand) and is not intended to limit the present disclosure to multifilament materials.

The knitting machine 100 may include a carriage 114 that is movable along the first needle bed 102 and the second needle bed 104 in a longitudinal direction 121 of knitting machine 100. An upper portion 116 of the carriage 114 may include a set of plungers (not shown in FIG. 1) that can selectively engage at least one of the feeders 108 such that the feeder 108 that is engaged moves along one of the rails 108 as the carriage 114 moves. As the carriage 114 moves along the first needle bed 102 and the second needle bed 104, the carriage 114 may selectively actuate needles of the first needle bed 102 and/or the second needle bed 104 such that the actuated needles move from the default position to the extended position. The actuation may be the result of a set of cams (not shown in FIG. 1) of the carriage 114 making contact with a butt portion of the needles and forcing the needles to move from the default position to the extended position as the carriage 114 passes. Due to the action of the carriage 114, the feeder 108, and the needles 101, the yarn 112 may be dispensed from the feeder 108 and to the needles 101 of at least one of the first needle bed 102 and the second needle bed 104. The needles 101 and/or feeders 108 can therefore receive yarn 112 and can perform various knitting procedures for incorporating yarn 112 into a knitted component. For example, the components of the knitting machine 100 can knit, tuck, float, inlay, or otherwise manipulate yarn 112 to form a knitted component.

According to an embodiment of the present disclosure, the carriage 114 may comprise a first carriage **114*a* and a second carriage 114*b*, while the upper portion 116 may comprise a first upper portion 116*a* and a second upper portion 116*b*. In this arrangement, the first carriage 114*a* and the first upper portion 116*a* may be entirely separate from the second carriage 114*b* and the second upper portion 116*b*, such that the first carriage 114*a* and the first upper portion 116*a* can move in any direction relative to the second carriage 114*b* and the second carriage 116*a*. For example, in this arrangement, the first carriage 114*a* and the first upper portion 116*a* may move relative to the second carriage 114*b* and the second upper portion 116*b* along the front needle bed 102 in the longitudinal direction 121, while the second carriage 114*b* and the second upper portion 116*b* remain stationary or move in a different direction, or at a different speed. Or, the first carriage 114*a* and the first upper portion 116*a* may move with the first needle bed 102 relative to the second carriage 114*b* and the second upper portion 1116*b*, as the first needle bed 102 moves relative to the second needle bed 104**, as further described below.

According to another embodiment of the present disclosure, the first carriage **114*a* and the first upper portion 116*a* may be operatively coupled to the second carriage 114*b* and the second upper portion 116*b*, such that the first carriage 114*a* and the first upper portion 116*a* move in unison with the second carriage 114*b* and the second upper portion 116*b* in the longitudinal direction 121, while still permitting movement of the first carriage 114*a* and the first upper portion 116*a* toward and/or away from the second carriage 114*b* and the second upper portion 116*b* (e.g., in directions substantially perpendicular to the longitudinal direction 121). In this arrangement, the first upper portion 116*a* and the second upper portion 116*b*** may be operatively coupled to allow such relative movement by any suitable means, including but not limited to a telescoping arrangement, a threaded arrangement, a series of linkages, etc.

As illustrated in FIG. 1, the knitting machine 100 further includes an actuator 118 for selectively moving the position of the first needle bed 102 and/or the second needle bed 104 relative to one another, as further described below. In one embodiment, the actuator 118 may comprise an electric motor. The electric motor may be controlled, for example, by a computing interface, dials, switches, etc. (not shown in FIG. 1). Alternatively, the actuator 118 may comprise a manual input for moving the first needle bed 102 and/or the second needle bed relative to one another. For example, the manual input may comprise one or more levers, rotatable shafts, etc. (not shown in FIG. 1) for manipulation by an operator. Those skilled in the art will appreciate that the actuator 118 may be operatively connected to the first needle bed 102 and/or the second needle bed 104 by any means suitable for transmitting rotational and/or linear movement, including for example, one or more shafts, gears, or linkages, and that transmission of the rotational and/or linear movement to the first needle bed 102 and/or the second needle bed 104 may result in rotation of the needle bed(s), linear movement of the needle bed(s), or a combination of both rotation and linear movement of the needle bed(s), as further described below.

Needle Beds and Feeder Arrangement

Figure 3:
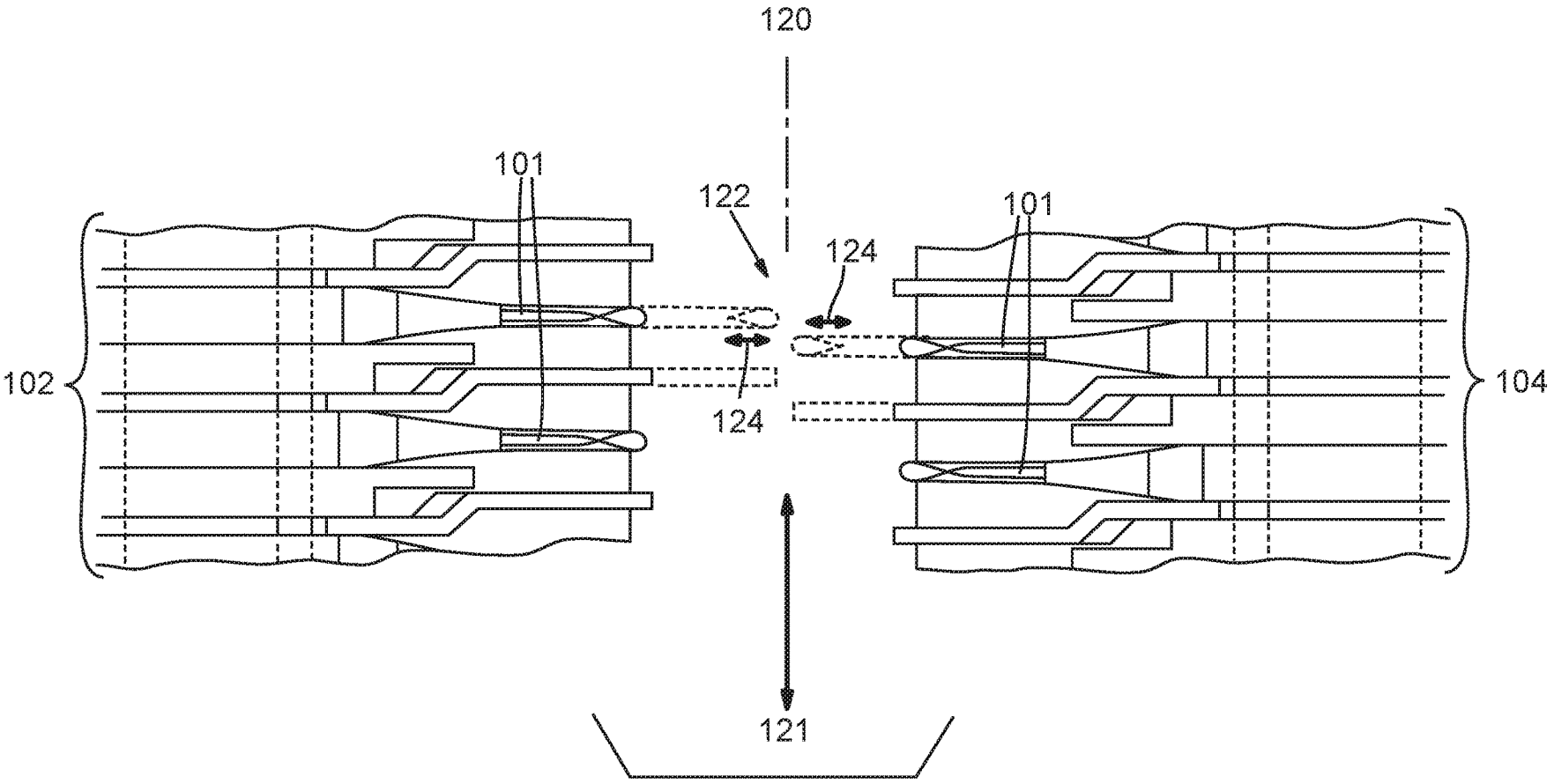
FIG. 3 is a top view of a needle bed of the knitting machine of FIG. 1.
Figure 4:
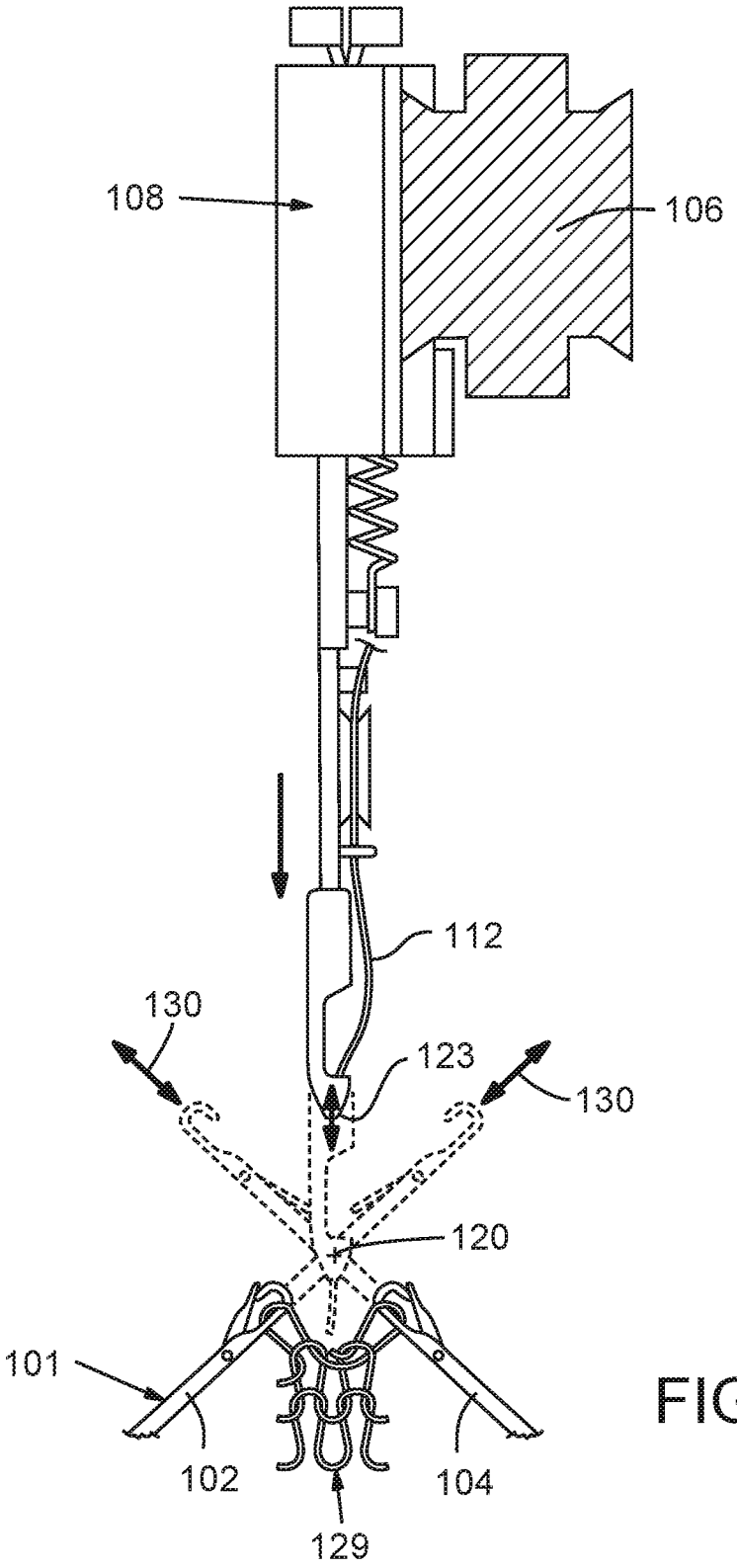
FIG. 4 is an end view of needles and a yarn feeder of the knitting machine illustrating a knitting process according to exemplary embodiments of the present disclosure.
Figure 5:
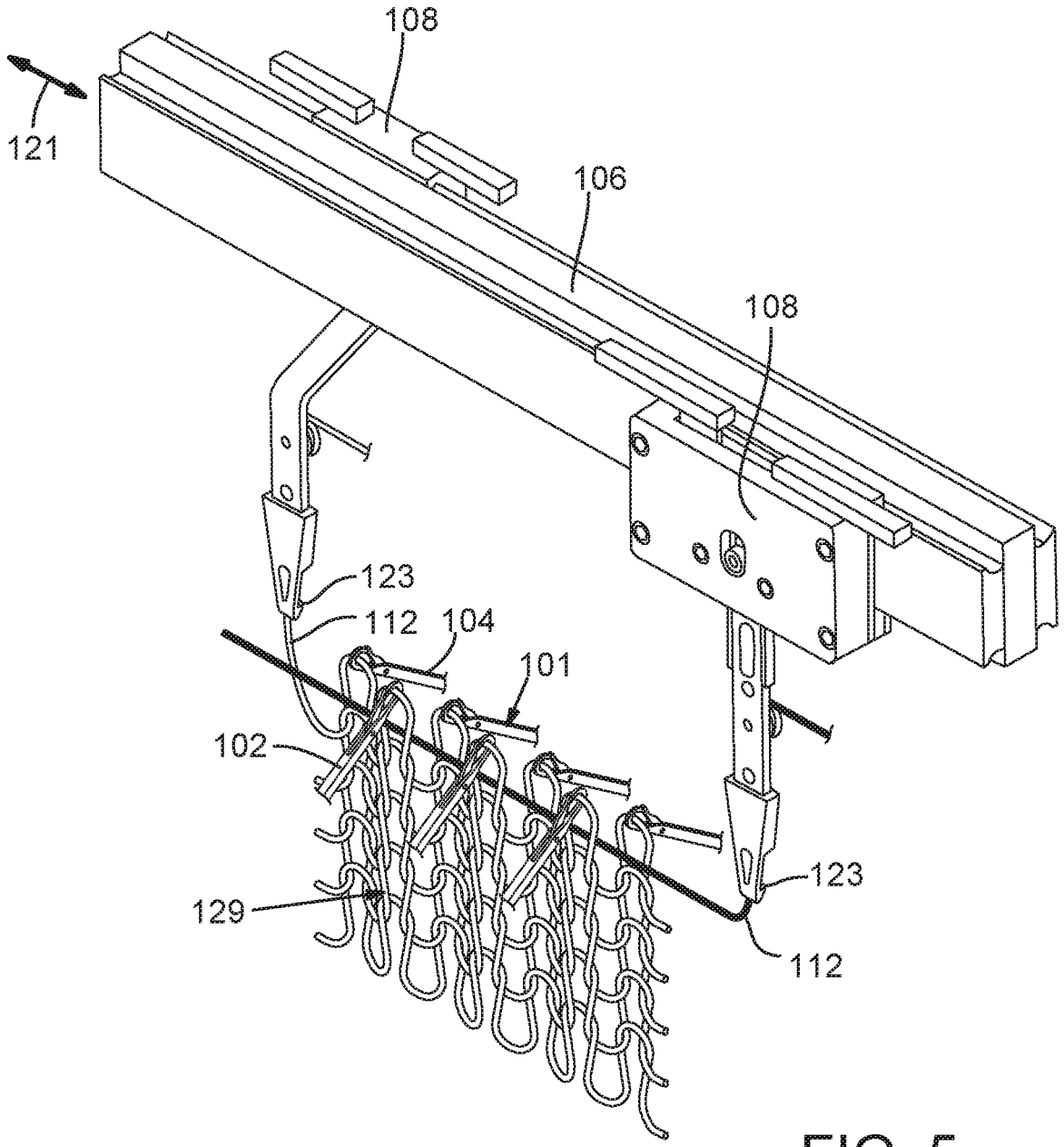
FIG. 5 is a perspective view of portions of the knitting machine of FIG. 1.

An exemplary arrangement of the first needle bed 102, the second needle bed 104, and a feeder 108 of the knitting machine 100 is further illustrated in FIGS. 3-5. As illustrated in FIG. 3, needles 101 can be configured to move relative to intersection 120 and relative to other needles 101 within the respective bed. For example, as shown in FIG. 3, needles 101 can be configured to move between a retracted position and an extended position. Needles 101 are shown in the retracted position with solid lines and in the extended position with broken lines in FIG. 3. In the retracted position, needles 101 can be spaced apart from intersection 120. In the extended position, needles 101 can be extended through intersection 120. This movement of needles 102 can be substantially linear as represented by arrows 124 in FIG. 3.

In some embodiments, in addition to moving along the longitudinal direction 121, feeder 108 can be configured to move relative to needles 101 between a retracted position and an extended position, and in order to accommodate any changes in the position of intersection 120 due to a change in the position(s) of the first needle bed 102 and/or the second needle bed 104. For example, in the embodiment of FIG. 4, feeder 108 is shown in the retracted position with solid lines, and feeder 108 is shown in the extended position with broken lines. In the retracted position, an end 123 of feeder 108 can be disposed above the intersection 120 in some embodiments. In the extended position, end 123 of feeder 108 can be disposed below the intersection 120. Also, while in the extended position, feeder 108 can feed yarn 112 toward needles 101 to be inlaid within a knitted component 129, as represented in FIG. 5. In contrast, when in the retracted position, feeder 108 can feed yarn 112 toward needles 101 to form loops, tucks, floats, or other features of knitted component 129. Additionally, feeder 108 and other features of knitting machine 100 can be configured according to the teachings of U.S. Pat. No. 8,522,577, which issued on Sep. 3, 2013, and which is incorporated by reference in its entirety.

It will be appreciated that, in other embodiments, or in specific applications, feeder 108 can have a single, fixed position relative to intersection 120. For example, in some embodiments and applications, feeder 108 can remain above the intersection 120 as feeder 108 moves in the longitudinal direction 121 of knitting machine 100. Also, in some embodiments and applications, feeder 108 can remain below the intersection 120 as feeder 108 moves in the longitudinal direction 121 of knitting machine 100.

Needle Bed Adjustment

FIGS. 6A-D are exemplary non-limiting illustrations showing selective adjustment of the first needle bed 102 and/or the second needle bed 104 of the knitting machine 100 relative to one another. It should be appreciated that the needles 101 of the first needle bed 102 and the second needle bed 104 in the illustrations of FIGS. 6A-D are generally aligned in the planes defined by the positions of the needles 101, and extending in the longitudinal direction 121 (i.e., into and out of the page); however, for purposes of illustration, only a single needle 101 in each needle bed is illustrated. Moreover, it should be appreciated that the position of the intersection 120 of the first needle bed 102 and the second needle bed 104 may move as the position of the first needle bed and/or the second needle bed 104 is selectively adjusted, such that the feeders 108 of the knitting machine 101 must also move to accommodate any change in the position of the intersection 120.

Figure 6A:
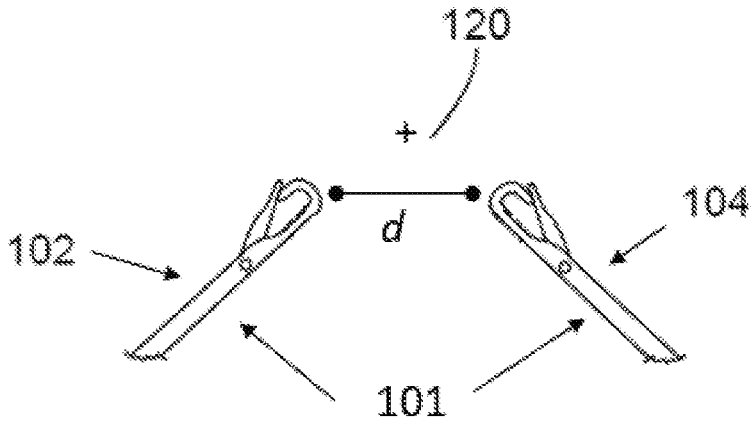
FIGS. 6A-D are illustrations showing the selective adjustment of a first needle bed and/or a second needle bed of the knitting machine of FIG. 1.

As illustrated in FIGS. 6A-D, the first needle bed 102 and/or the second needle bed 104 are moveable relative to one another, such that a distance d between the ends of the needles 101 of the first needle bed 102 and the second needle bed 104 is adjustable. As illustrated in FIG. 6A, the first needle bed 102 and the second needle bed 104 may ordinarily be positioned relative to one another such that the ends of the needles 101 of each needle bed are separated by a distance d. The position of the first needle bed 102 and the second needle bed 104 in FIG. 6A may be the same as that illustrated by FIGS. 2 and 4-5.

Figure 6B:
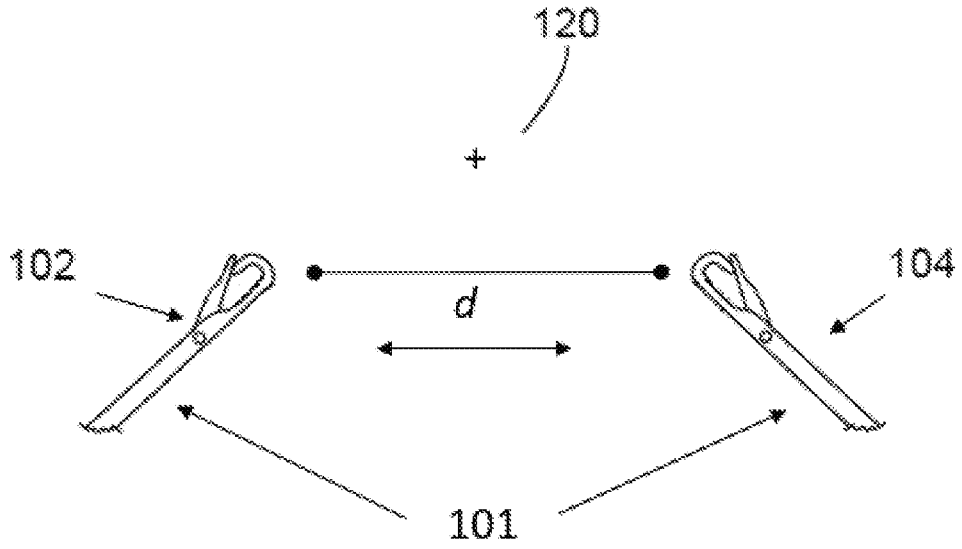
Figure 6C:
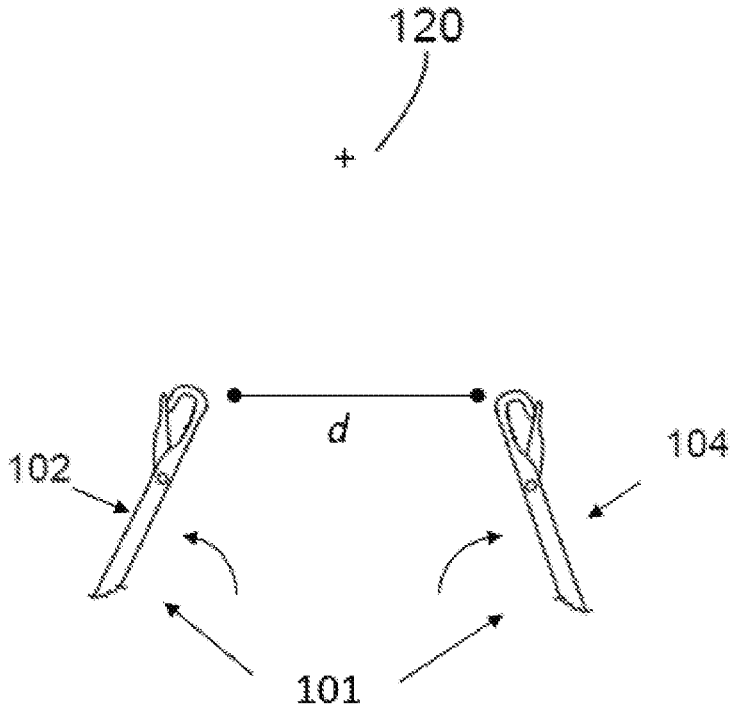
Figure 6D:
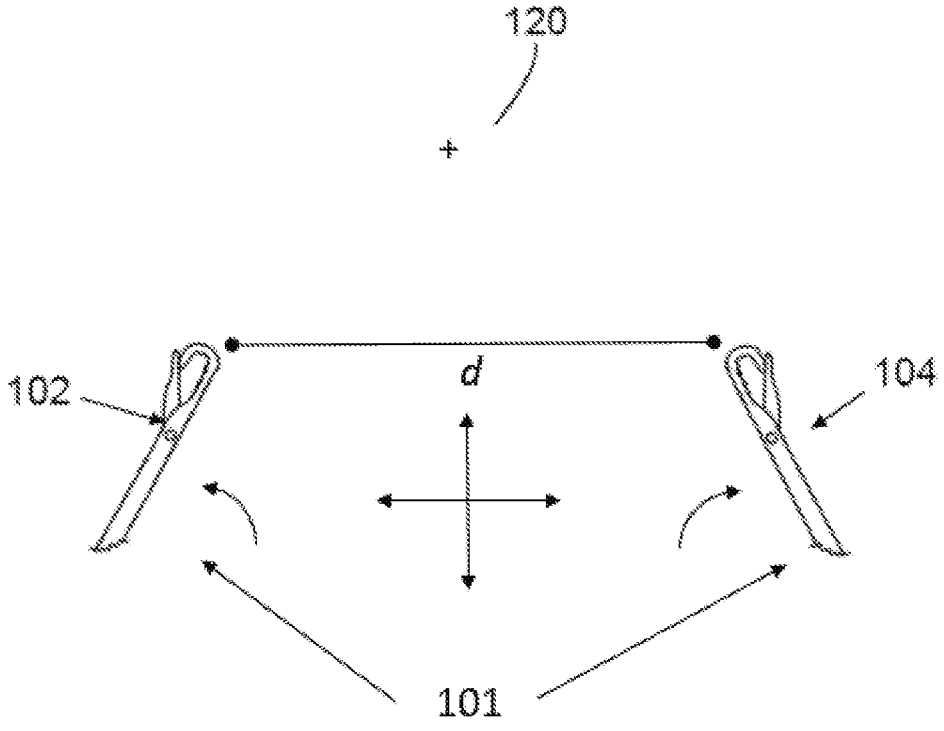

Using the actuator 118, the position of the first needle bed 102 relative to the second needle bed 104, and the distance d between the ends of the needles 101 of each needle bed, may be selectively adjusted, for example, to the position(s) shown in FIG. 6B, by moving the first needle bed 102 and/or the second needle bed 104 horizontally away from one another (i.e., in a direction perpendicular to the axis 120). Alternatively, the position of the first needle bed 102 relative to the second needle bed 104, and the distance d between the ends of the needles 101 of each needle bed, may be selectively adjusted, for example, to the position(s) shown in FIG. 6C, by rotating the first needled bed 102 and/or the second needle bed 104 away from one another (i.e., rotating the first needle bed 102 counter-clockwise and/or the second needle bed 104 clockwise). Or, the position of the first needle bed 102 relative to the second needle bed 104, and the distance d between the ends of the needles 101 of each needle bed, may be selectively adjusted, for example, to the position(s) shown in FIG. 6D, by one or more of the following: a) moving the first needle bed 102 and/or the second needle bed 104 horizontally away from one another, b) moving the first needle bed 102 and/or the second needle bed 104 vertically, and/or c) rotating the first needle bed 102 and/or the second needle bed 104 away from one another. To be clear, it is envisioned that one or both of the first needle bed 102 and the second needle bed 104 may be moved according to any one or more of the illustrated movements to selectively adjust the distance d between the ends of the needle beds.

In some embodiments, the distance d between the ends of the needles 101 of the first needle bed 102 and the second needle bed 104 may be selectively adjusted such that the distance d ranges from 5 mm to 15 mm. In some embodiments, however, the distance d may be selectively adjusted such that the distance d is decreased to 1 mm, or less. In other embodiments, the distance d may be selectively adjusted such that the distance d exceeds 30 mm, 40 mm, or even 50 mm.

If is further envisioned that the position of only a portion or select portions of the needles 101 within the first needle bed 102 and/or the second needle bed 104 may be selectively adjusted such that only the distance between the ends of the needles 101 within the portion or select portions is adjusted. Similarly, it is envisioned that the positions of a first portion and a second portion of the needles 101 within the first needle bed 102 and/or the second needle bed 04 may be selectively adjusted by differing amounts.

Variable Thickness Spacer Knit Fabrics

FIGS. 7A-E illustrate selective adjustment of the first needle bed 102 and/or the second needle bed 104 between formation of courses of a spacer knit fabric, using the knitting machine 100, to obtain a variable thickness spacer knit construction. FIGS. 8A-E illustrate selective adjustment of the first needle bed 102 and/or the second needle bed 104 after partial formation of a course of a spacer knit fabric, using the knitting machine 100, to obtain a variable thickness spacer knit construction. The illustrations of FIGS. 7A-E and 8A-E are only exemplary, and illustrate formation of a spacer knit fabric having variable thickness on a weft knitting machine having a first needle bed 102 and a second needle bed 104. The knitted structures formed by the processes in FIGS. 7A-D and 8A-D may differ in the types of machines on which they are formed, the number of needles used, whether needles are skipped, the number of skipped needles, the specific knit structures (e.g., tucks vs. loops), the types and number of yarns or materials used, the inclusion of one or more inlaid strands, the size of certain sections/areas constituting the spacer knit construction, inclusion of adjoining or adjacent sections of other constructions (e.g., a double jersey knit construction), etc.

Figure 7A:
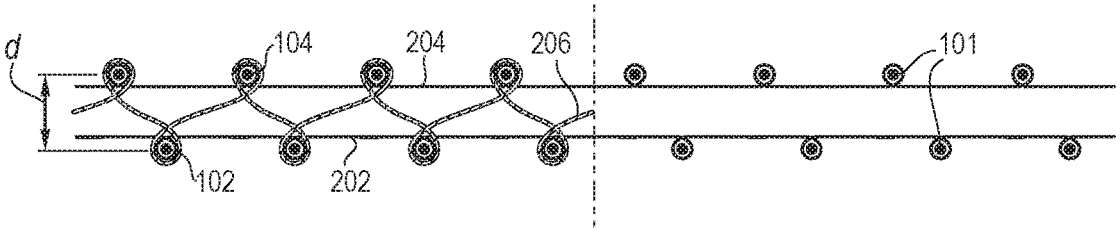
FIGS. 7A-E are illustrations showing selective adjustment of the first needle bed and/or the second needle bed of the knitting machine of FIG. 1, between formation of courses of a spacer knit construction, to form a variable thickness spacer knit fabric.
Figure 7B:
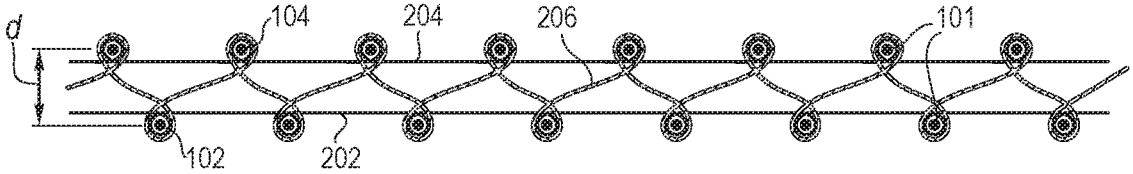

FIGS. 7A-B illustrate a form of conventional spacer knit construction. In FIGS. 7A-B, the position of the needles 101 of the first needle bed 102 and the second needle bed 104 are spaced relative to one another by a distance d. In both FIGS. 7A and 7B, the knitting machine 100 has formed loops of a first yarn 202 on the first needle bed 102, and loops of a second yarn 204 (which may be common to the first yarn 202) on the second needle bed 104, both having a single jersey knit structure (herein defined as a structure formed on a single needle bed using some or all of the needles). The loops of the first yarn 202 may form a first surface of the spacer knit construction, while the loops of the second yarn 204 may form a second surface of the spacer knit construction, the first surface being separate from the second surface.

For purposes of illustration, in FIG. 7A, a spacer strand 206 only partially extends along the course of the yarn 202 and the yarn 204, and is looped around alternating needles 101 of the first needle bed 102 and the second needle bed 104, to interlock with the first yarn 202 and with the second yarn 204. In FIG. 7B, the spacer strand 206 extends the length of the course of the first yarn 202 and the second yarn 204. Spacer strand 206 may alternatively be tucked behind alternating needles 101 of the first needle bed 102 and the second needle bed 104 to interlock with the first yarn 202 and with the second yarn 204. In general, the spacer strand 206 may be common to the first yarn 202 and/or the second yarn 204. Alternatively, the spacer strand 206 may comprise a monofilament of a material selected to provide a desired level of breathability, energy absorption, compression strength, insulation, pressure distribution, dispersion of moisture, etc.

Figure 7C:
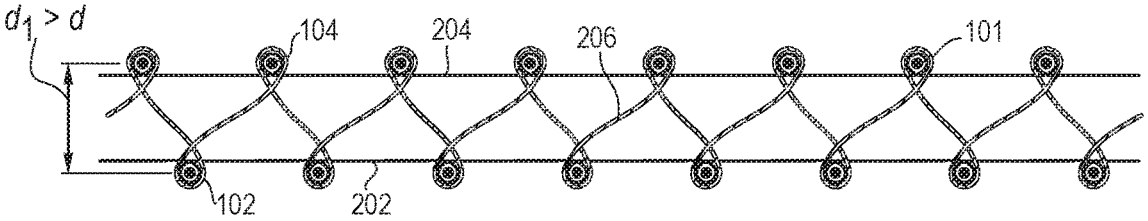

FIG. 7C illustrates the formation of a subsequent course of the first yarn 202 and the second yarn 204, following formation of the courses illustrated in FIGS. 7A-B. However, prior to forming the courses in FIG. 7C, the distance between the needles 101 of the first needle bed 102 and the second needle 104 is selectively adjusted, for example, using actuator 118, such that the first needle bed 102 and the second needle bed 104 are spaced relative to one another by a distance $d_1$, where $d_1$ is greater than the distance d, illustrated in FIGS. 7A-B. In FIG. 7C, the knitting machine 100 has again formed loops of a first yarn 202 on the first needle bed 102, and loops of a second yarn 204 (which may be common to the first yarn 202) on the second needle bed 104, both having a single jersey knit structure. Again, the spacer strand 206 is looped around alternating needles 101 of the first needle bed 102 and the second needle bed 104, to interlock with the first yarn 202 and with the second yarn 204.

Figure 7D:
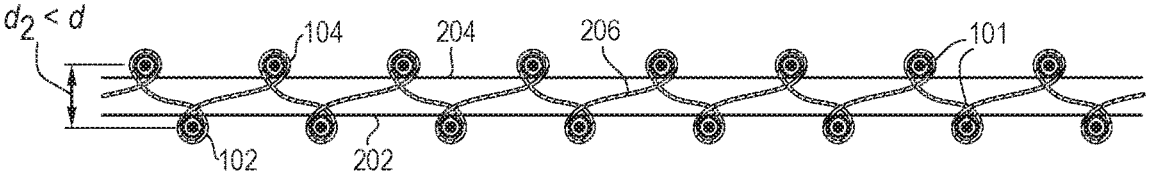

FIG. 7D illustrates the formation of a another course of the first yarn 202 and the second yarn 204, following formation of the courses illustrated in FIGS. 7A-B, and/or following formation of the courses illustrated in FIG. 7C. However, prior to forming the courses in FIG. 7D, the distance between the needles 101 of the first needle bed 102 and the second needle 104 is selectively adjusted, for example, using actuator 118, such that the first needle bed 102 and the second needle bed 104 are spaced relative to one another by a distance $d_2$, where $d_2$ is less than the distance d, illustrated in FIGS. 7A-B. The arrangement of the first yarn 202, the second yarn 204, and the spacer strand 206 of FIG. 7D is otherwise the same as those described with reference to FIGS. 7A-C.

By selectively increasing and/or decreasing the distance d between the needles 101 of the first needle bed 101 and the second needle bed 104, in between the formation of courses of a knitted component having a spacer knit construction, a knitting machine (such as the knitting machine 100) may knit a fabric having a variable thickness (i.e., as measured between the first layer and the second layer of the spacer knit construction) when viewed in the direction perpendicular to the direction of the courses (i.e., in the direction of the wales). By changing the distance d between the formation of courses incrementally, periodically, and/or at varying rates, any number of slopes, curves, and/or plateaus may be formed in the direction perpendicular to the direction of the courses. Moreover, this variable thickness spacer-knit construction may be included within a larger knitted component formed as an integral one-piece element from a single knitting process. That is, the first yarn 202 and the second yarn 204 used in the formation of a first region of spacer knit construction, having a first thickness, may be the same as the first yarn 202 and the second yarn 204 used in the formation of a second region of spacer knit construction (or a third region, a fourth region, etc.), having a second thickness different than the first thickness (or a third thickness, a fourth thickness, etc., different than the first thickness). Likewise, the spacer strand 206 (or multiple spacer strands 206) used in the formation of a first region of spacer knit construction, having a first thickness, may be the same as the spacer strand 206 (or multiple spacer strands 206) used in the formation of a second region of spacer knit construction (or a third region, a fourth region, etc.), having a second thickness different than the first thickness (or a third thickness, a fourth thickness, etc., different than the first thickness).

Figure 7E:
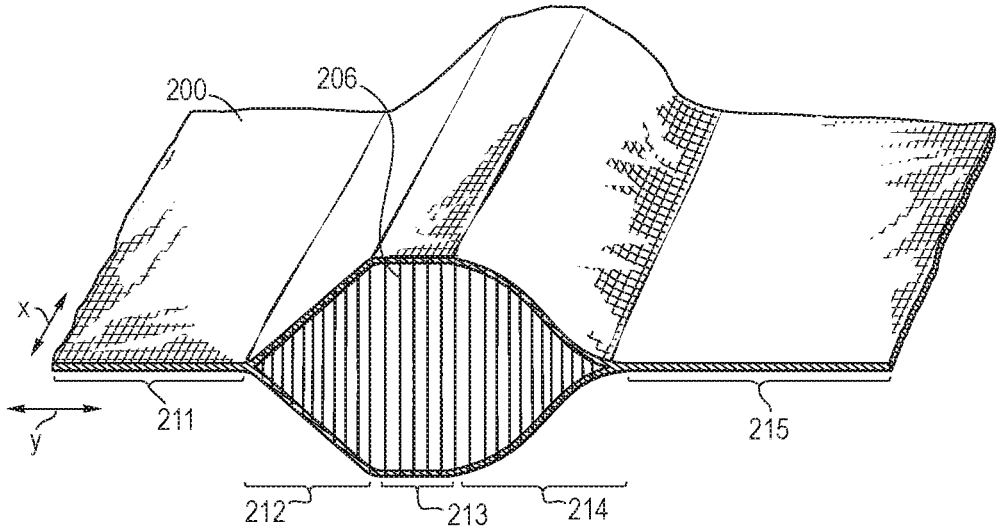

Solely by way of example, as illustrated in FIG. 7E, a knitted component 210 formed on the knitting machine 100 comprises a plurality of courses, running in the x-direction, and a plurality of wales, running in the-y direction. The knitted component 210 may comprise a first region 211 and a fifth region 215 having a double jersey knit structure (i.e., where loops of yarn are formed on both the first needle bed 102 and the second needle bed 104), with one or more regions having a variable thickness spacer knit construction formed therebetween. For example, in a second region 212, the knitting machine 100 may switch from the double jersey knit structure of the first region 211, to a spacer knit construction, such as that illustrated in FIGS. 7A-B. In the second region 212, following the formation of each course, including the interlocking process using spacer strand 206, the distance d between the first needle bed 102 and the second needle bed 104 is increased by a set amount, or linearly, thereby forming a slope, and a spacer knit fabric of variable thickness. In the third region 213, the distance d remains constant between the formation of courses, thereby forming a plateau, and a spacer knit fabric of greater thickness than the thickness regions 212, 214, and 215. In the fourth region 214, the distanced decreases between the formation of courses at an exponential, or non-linear rate, thereby forming a curve, and a spacer knit fabric of variable thickness. In the fifth region 215, the knitting machine 100 may switch from the spacer knit construction of regions 212, 213, and 214, back to the double jersey knit structure of the first region 211.

Figure 8A:
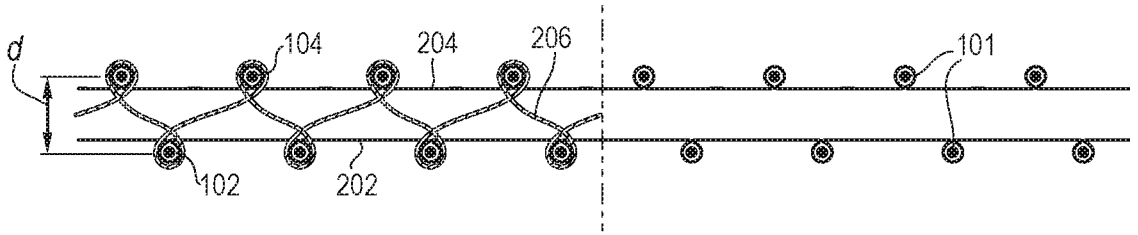
FIGS. 8A-D are illustrations showing selective adjustment of the first needle bed and/or the second needle bed of the knitting machine of FIG. 1, after partial formation of a course of a spacer knit construction, to form a variable thickness spacer knit fabric.

FIG. 8A also illustrates a form of conventional spacer knit construction. In FIG. 8A, the position of the needles 101 of the first needle bed 102 and the second needle bed 104 are spaced relative to one another by a distance d. Once again, the knitting machine 100 has formed loops of a first yarn 202 on the first needle bed 102, and loops of a second yarn 204 (which may be common to the first yarn 202) on the second needle bed 104, both having a single jersey knit structure. A spacer strand 206 partially extends along the course of the yarn 202 and the yarn 204, and is looped around alternating needles 101 of the first needle bed 102 and the second needle bed 104, to interlock with the first yarn 202 and with the second yarn 204. Again, spacer strand 206 may alternatively be tucked behind alternating needles 101 of the first needle bed 102 and the second needle bed 104 to interlock with the first yarn 202 and with the second yarn 204.

Figure 8B:
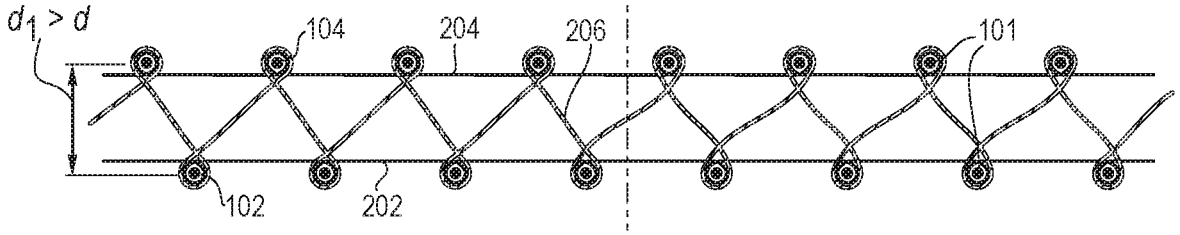
Figure 8C:
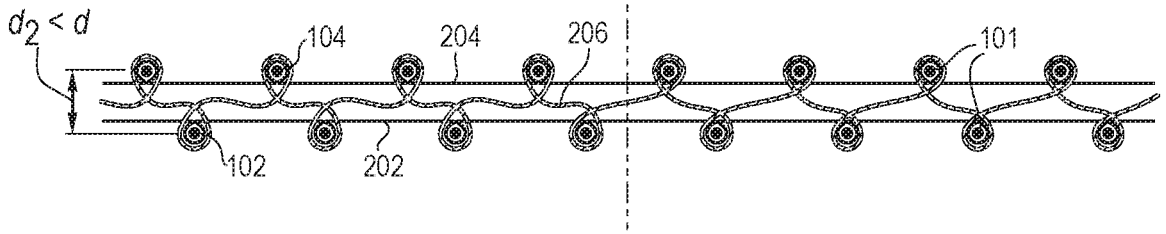

In the illustration of FIGS. 8A-8C, unlike with the illustration of FIGS. 7A-D, the distance d between the position of the needles 101 of the first needle bed 102 and the second needle bed 104 is selectively adjusted during the formation of courses. For example, after partially interlocking the spacer strand 206 with the first yarn 202 and with the second yard 204, as illustrated in FIG. 8A, the distance d between the needles 101 of the first needle bed 102 and the second needle 104 may be selectively adjusted, for example, using actuator 118, such that the first needle bed 102 and the second needle bed 104 are spaced relative to one another by a distance $d_1$, where $d_1$ is greater than the distance d, as illustrated in FIG. 8B. As illustrated in FIG. 8B, and depending on the material(s) selected for the spacer strand 206, the slack in the spacer strand 206 interlocked with the first yarn 202 and with the second yarn 204 prior to adjustment of the distance d may be reduced with any such adjustment. Those skilled in the art will appreciate that the amount of slack in the spacer strand 206, whether before and/or after adjustment of the distance d, may be controlled by the feed rate of spacer strand 206 as it is dispensed from feeder(s) 106. After the distance d is adjusted, the remainder of the first yarn 202 and the second yard 204 is interlocked with the spacer strand 206, as illustrated in FIG. 8B.

In addition, or alternatively, for example, after partially interlocking the spacer strand 206 with the first yarn 202 and with the second yarn 204, illustrated in FIG. 8A, the distance between the needles 101 of the first needle bed 102 and the second needle 104 may be selectively adjusted, for example, using actuator 118, such that the first needle bed 102 and the second needle bed 104 are spaced relative to one another by a distance $d_2$, where $d_2$ is greater than the distance d, as illustrated in FIG. 8C. Again, as illustrated in FIG. 8C, and depending on the material(s) selected for the spacer strand 206, the slack in the spacer strand 206 interlocked with the first yarn 202 and with the second yarn 204 prior to adjustment of the distance d, may be increased with any such adjustment. After the distance d is adjusted, the remainder of the first yarn 202 and the second yard 204 is interlocked with the spacer strand 206, as illustrated in FIG. 8C.

By selectively increasing and/or decreasing the distance d between the needles 101 of the first needle bed 101 and the second needle bed 104 during formation of the courses of a knitted component having a spacer knit construction, a knitting machine (such as the knitting machine 100) may knit a fabric having a variable thickness (i.e., as measured between the first layer and the second layer of the spacer knit construction) when viewed in the direction of the courses (i.e., parallel to the courses). By changing the distance d during the formation of courses, for example, incrementally and/or at varying rates, continuously and/or periodically, any number of slopes, curves, and/or plateaus may be formed in the direction of the courses. Moreover, this variable thickness spacer-knit construction may be included within a larger knitted component formed as an integral one-piece element from a single knitting process. That is, the first yarn 202 and the second yarn 204 used in the formation of a first region of spacer knit construction, having a first thickness, may be the same as the first yarn 202 and the second yarn 204 used in the formation of a second region of spacer knit construction (or a third region, a fourth region, etc.), having a second thickness different than the first thickness (or a third thickness, a fourth thickness, etc., different than the first thickness). Likewise, the spacer strand 206 (or multiple spacer strands 206) used in the formation of a first region of spacer knit construction, having a first thickness, may be the same as the spacer strand 206 (or multiple spacer strands 206) used in the formation of a second region of spacer knit construction (or a third region, a fourth region, etc.), having a second thickness different than the first thickness (or a third thickness, a fourth thickness, etc., different than the first thickness).

Figure 8D:
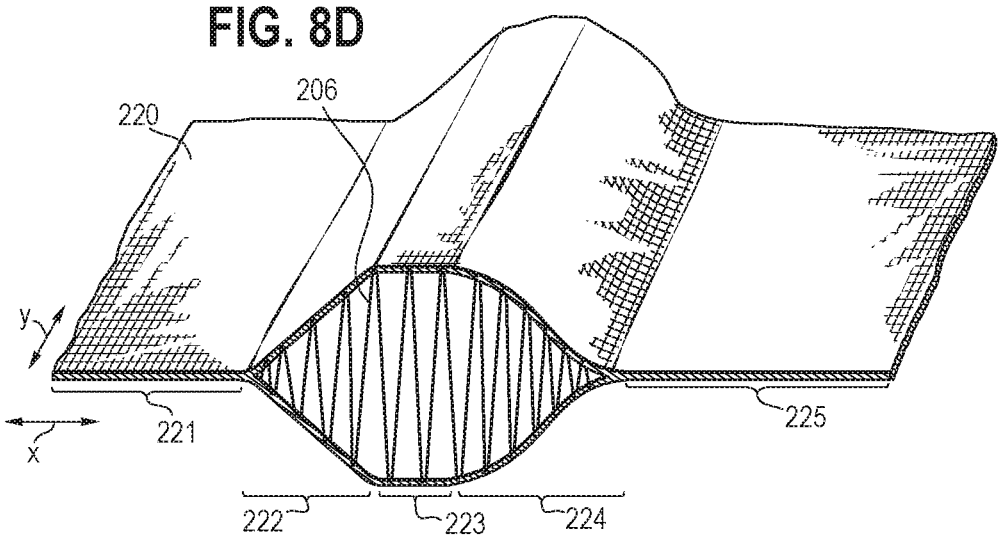

Solely by way of example, as illustrated in FIG. 8D, a knitted component 220 formed on the knitting machine 100 comprises a plurality of courses, running in the x-direction, and a plurality of wales, running in the-y direction. The knitted component 220 may comprise a first region 221 and a fifth region 225 having a double jersey knit structure (i.e., where loops of a common yarn are formed on both the first needle bed 102 and the second needle bed 104), with one or more regions having a variable thickness spacer knit construction formed therebetween. For example, in a second region 222, the knitting machine 100 may switch from the double jersey knit structure of the first region 221, to a spacer knit construction, such as that illustrated in FIG. 8A. In the second region 222, during the formation of each course, including the interlocking process using spacer strand 206, the distance d between the first needle bed 102 and the second needle bed 104 is gradually increased at a constant rate, or linearly, as the course is formed, thereby forming a slope, and a spacer knit fabric of variable thickness. In the third region 223, the distance d remains constant during the formation of each course, thereby forming a plateau, and a spacer knit fabric of greater thickness than the thickness regions 222, 224, and 225. In the fourth region 224, the distance d decreases at an exponential, or non-linear rate during the formation of each course, thereby forming a curve, and a spacer knit fabric of variable thickness. In the fifth region 225, the knitting machine 100 may switch from the spacer knit construction of regions 212, 213, and 214, back to the double jersey knit structure of the first region 111.

By combining the various processes illustrated in FIGS. 7A-D and 8A-C, a knitted component may be formed to include a single region or multiple regions of variable thickness spacer knit construction having any number of three-dimensional shapes, contours, and/or topographies, extending in both the direction of the courses and wales of the knitted component. That is, the distance d between the needles 101 of the first needle bed 101 and the second needle bed 104 may be selectively adjusted both during formation of a course including a spacer knit construction, and between courses including a spacer knit construction. Solely by way of example, such variable thickness spacer knit constructions may be strategically placed in zones or regions of a knitted component selected for enhanced breathability, energy absorption, compression strength, insulation, pressure distribution, good dispersion of moisture, etc. In addition, or alternatively, such variable thickness spacer knit constructions may be utilized for aesthetic purposes, including, for example, the creation of logos, patterns, or other design elements.

In some embodiments, the thickness of the knitted component formed by the various processes illustrated in FIGS. 7A-D and 8A-C may be selectively adjusted such that the thickness varies from 5 mm to 15 mm. In some embodiments, however, the thickness may be selectively adjusted such that the thickness is decreased to 1 mm, or less. In other embodiments, the thickness may be selectively adjusted such that the thickness exceeds 30 mm, 40 mm, or even 50 mm.

Additional Embodiments

Figure 9:
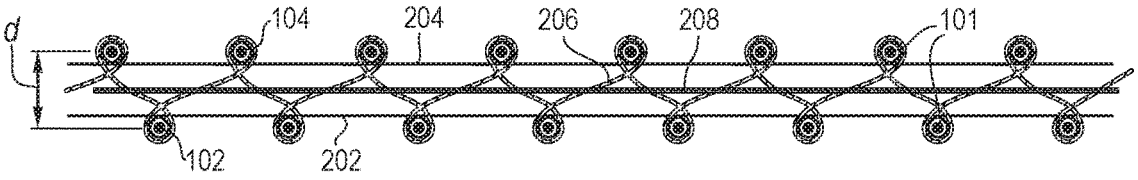
FIG. 9 is an illustration showing formation of a variable thickness spacer knit fabric, according to the processes of FIGS. 7A-E and 8A-D, having at least one inlaid strand.

FIGS. 9-12 are illustrations showing further formation and applications of variable thickness spacer knit constructions, according to the processes of FIGS. 7A-E and 8A-D. For example, as illustrated in FIG. 9, an inlaid strand 208 may be included in the formation of one or more courses, either before or after the spacer strand 206 is interlocked with the first yarn 202 and with the second yarn 204, and either before or after the distance d between the needles 101 of the first needle bed 102 and the second needle bed 104 is selectively adjusted. Although FIG. 9 illustrates only a single inlaid strand 208, it is also envisioned that two or more inlaid strands 208 may be included in the formation of the one or more courses of the variable thickness spacer knit construction, and that the two or more inlaid strands 208 may be positioned on the same or opposite sides of the spacer strand 206. The two or more inlaid strands 208 may comprise any number of suitable materials, and may be made of the same material(s), or alternatively, may comprise different materials and/or colors.

In one embodiment, the inlaid strand(s) 208 may comprise a cushioning yarn. The cushioning yarn may have a full diameter (e.g., when not restricted or compressed) of about 1/16" or larger, for example, though other cushioning yarns may have other diameters (e.g., 1/8", 1/4", or even larger). Two non-limiting exemplary examples of cushioning yarns are a 5500 denier version and a 3500 denier version of multifilament polyester yarn that has been texturized to loft. Particular examples are marketed as "LILY" yarns and are sold by Sawada Hong Kong Co. Ltd., though other yarns from other manufacturers may also be cushioning yarns. A more detailed description of cushioning yarns, and the use of cushioning yarns as an inlaid strand, is set forth in U.S. Non-Provisional application Ser. No. 16/383,275, filed on Apr. 12, 2019, which claims the benefit of U.S. Provisional Application No. 62/657,451, filed Apr. 13, 2018, both of which are herein incorporated by reference in their entireties.

Figure 10:
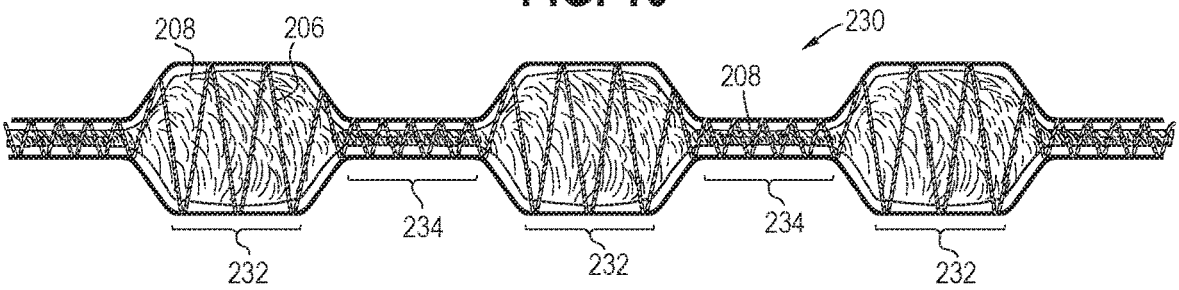
FIG. 10 is an illustration of a variable thickness spacer knit fabric having an inlaid strand comprising a cushioning yarn.

FIG. 10 is an illustration of a variable thickness spacer knit fabric 230 having an inlaid strand 208 formed of a cushioning yarn. As illustrated, the inlaid strand 208 expands in regions 232 of the spacer knit construction, where the thickness of the spacer knit fabric 230 is wider, and remains compressed in regions 234, where the thickness of the spacer knit construction is narrower. In this way, the inlaid strand 208 can expand to a cushioning state in regions 232 of greater thickness, to provide increased cushioning relative to the regions 234 of lesser thickness.

Figure 11:
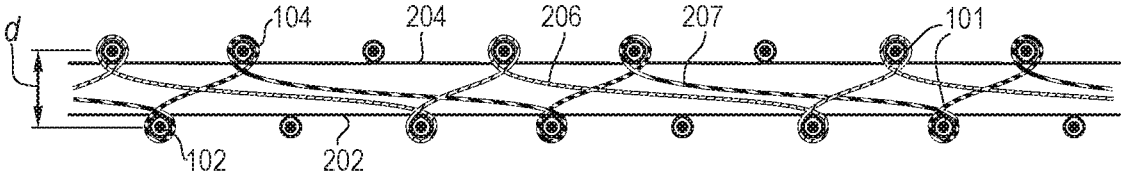
FIG. 11 is an illustration showing formation of a variable thickness spacer knit construction, according to the processes of FIGS. 7A-E and 8A-D, having at least two spacer strands, and/or having spacer strand(s) skipping needles of the first needle bed and the second needle bed.

FIG. 11 is an illustration showing formation of a variable thickness spacer knit construction according to the processes of FIGS. 7A-D and 8A-C, having at least two spacer strands 206, 207, and/or having spacer strand(s) that skip needles 101 of the first needle bed 102 and the second needle bed 104. During the formation of a variable thickness spacer knit construction according to the processes of FIGS. 7A-D and 8A-E, any number of spacer strands 206, 207 may be used, including for example, a first spacer strand 206, a second spacer strand 207, or more. The first spacer strand 206 and the second spacer strand 207 may comprise any number of suitable materials, and may be made of the same material(s), or alternatively, may comprise different materials and/or colors. As previously noted, the first spacer strand 206 and the second spacer strand 207 may comprise a monofilament. Alternatively, or additionally, the first spacer strand 206, and if included, the second spacer strand 207, or more, may skip one or more needles 101 during the interlocking process. Although the first spacer strand 206 and the second spacer strand 207 are illustrated in FIG. 11 as forming a loop on every third needle 101 of the first needle bed 102 and the second needle bed 104, the first spacer strand and the second spacer strand 207 could alternatively skip any number of needles 101.

Figure 12:
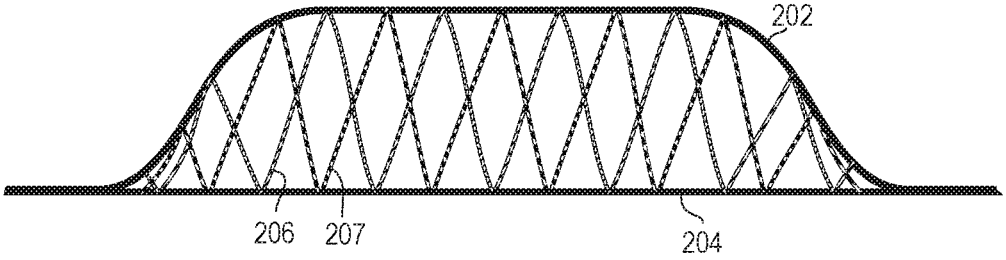
FIG. 12 is an illustration of a variable thickness spacer knit fabric having at least two spacer strands, wherein the spacer strands have multiple and/or different colors, and wherein the spacer strands may be visible through the spacer knit fabric; and, FIGS. 13-14 are further illustrations of the formation of a course of spacer knit construction.

FIG. 12 is an illustration of a variable thickness spacer knit construction 240 having at least a first spacer strand 206 and a second spacer strand 207. As previously noted, the first spacer strand 206 and the second spacer strand 207 may comprise different materials and/or colors. In this way, if one or both of the yarns 202, 204 (which may be common to one another) looped on the needles 101 of the first needle bed 102 and the second needle bed 104, respectively, are comprised of a transparent material, the various colors of the first spacer strand 206 and the second spacer strand 207 may become visible through the yarns 202, 204, thereby creating a unique aesthetic appearance.

Figure 13:
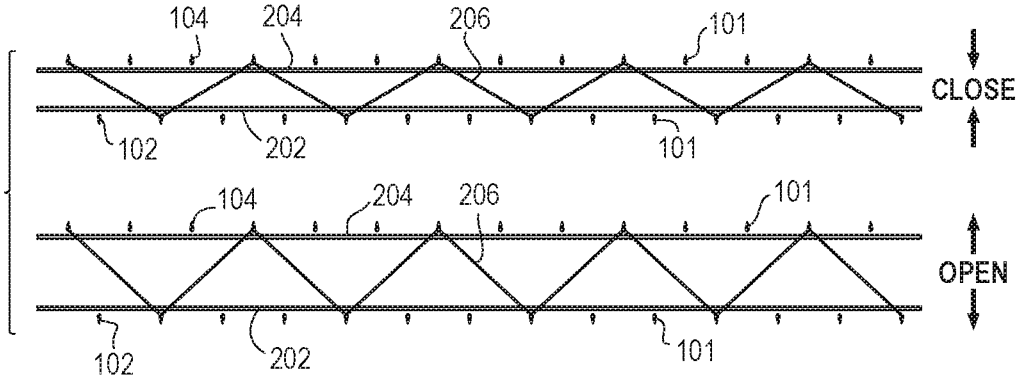
Figure 14:
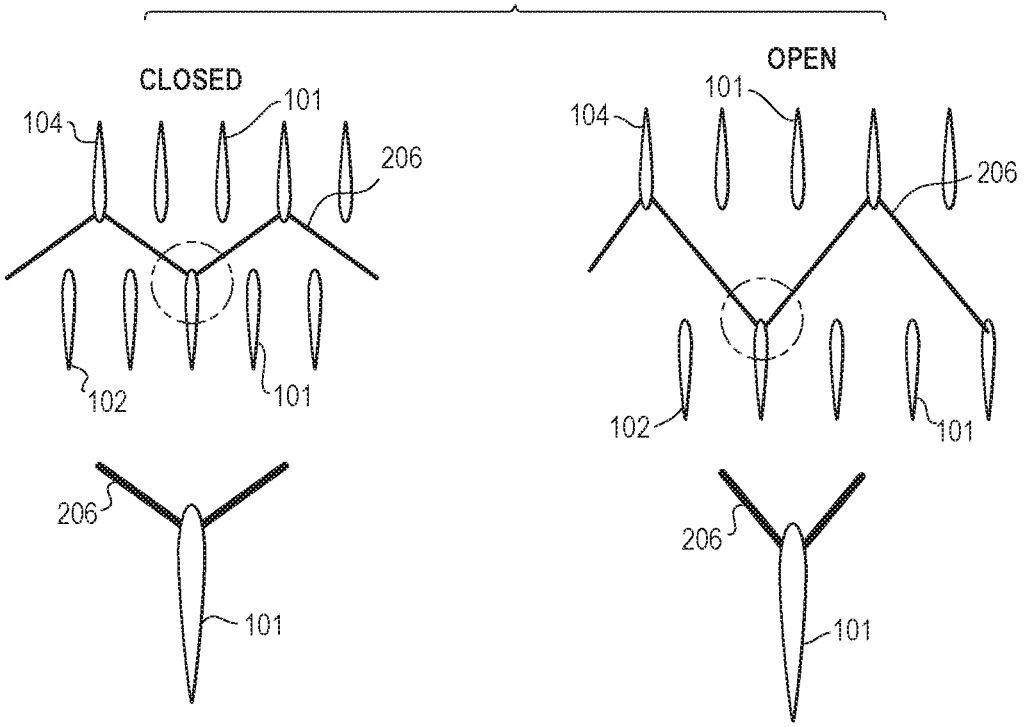

FIGS. 13-14 are further illustrations of the formation of a course of spacer knit construction according to the processes of FIGS. 7A-D and 8A-C. In the illustration of FIGS. 13-14, the spacer strand 206 is tucked behind needles 101 of the first needle bed 102 and the second needle bed 104. In addition, the spacer strand 206 is shown as skipping two needles 101 between tucks on each of the first needle bed 102 and the second needle bed 104. Moreover, as illustrated in FIG. 14, an angle of entry of the spacer strand 206 relative to the needles 101 of the first needle bed 102 and the second needle bed 104 may be changed along with selective adjustment of the position of the first needle bed 102 relative to the second needle bed 104. By changing the angle of entry of the spacer strand 206, and/or the number of needles 101 skipped between tucks, certain characteristics of the spacer knit construction may also be adjusted, including for example, its breathability, energy absorption, compression strength, insulation, pressure distribution, dispersion of moisture, etc.

Exemplary Implementations

In one aspect, a variable thickness knitted component includes a first region having a spacer knit construction, the first region having a first thickness, and a second region having the spacer knit construction, the second region having a second thickness different than the first thickness. The variable thickness knitted component may be an integral one-piece element. A spacer strand of the first region may be common to a spacer strand of the second region. The first thickness and the second thickness may be different when viewed in a direction of a course of the knitted component. The first thickness and the second thickness may also, or alternatively, be different when viewed in a direction of a wale of the knitted component. The spacer knit construction may include a first surface having a first set of loops and a second surface having a second set of loops, the first surface separate from the second surface, wherein each of the first set of loops and the second set of loops are interlocked with at least one spacer strand.

In another aspect, a variable thickness knitted component may include a region of spacer knit construction having a thickness that varies. Again, the knitted component may be an integral one-piece element. The region of spacer knit construction may be characterized by a spacer strand having a plurality of different lengths extending between a first surface and a second surface of the spacer knit construction, the first surface being separate from the second surface, wherein the plurality of different lengths define the thickness that varies. The thickness may vary when viewed in a direction of a course of the knitted component. Alternatively, the thickness may vary when viewed in a direction of a wale of the knitted component. Or, the thickness may vary when viewed in a direction of a course and a direction of a wale of the knitted component. The thickness may vary linearly or non-linearly. The variable thickness knitted component may also include at least one inlaid strand. The inlaid strand may be a cushioning yarn. The inlaid strand may also have a diameter that varies with the thickness of the spacer knit construction. The spacer knit construction may include a first surface having a first set of loops and a second surface having a second set of loops, the first surface separate from the second surface, wherein each of the first set of loops and the second set of loops are interlocked with at least one spacer strand. The at least one spacer strand may include a first strand having a first color and a second strand having a second color different from the first color, wherein at least one of the first surface or the second surface comprises a transparent material.

In another aspect, a method of forming a variable thickness knitted component on a knitting machine having a first needle bed and a second needle bed includes forming a plurality of courses of a spacer knit construction, the spacer knit construction comprising a first surface having a first set of loops formed on the first needle bed and a second surface having a second set of loops formed on the second needle bed, the first surface separate from the second surface. The method further includes interlocking at least one spacer strand with each of the first surface and the second surface, and adjusting the spacing between the first needle bed and the second needle bed while forming the plurality of courses of the spacer knit construction. The method may also include moving at least one of the first needle bend and/or the second needle bed while forming the plurality of courses of the spacer knit construction. Or, the method may also include rotating at least one of the first needle bed and/or the second needle bed while forming the plurality of courses of the spacer knit construction. Adjusting the spacing between the first needle bed and the second needle bed may occur while forming a course of the plurality of courses. Or, adjusting the spacing between the first needle bed and the second needle bed may occur between forming individual courses of the plurality of courses. The spacing may be adjusted linearly or non-linearly. The method may also include inserting at least one inlaid strand within a course of the plurality of courses.

In another aspect, a knitting machine includes a first needle bed comprising a first plurality of needles, a second needle bed comprising a second plurality of needles, the second plurality of needles angled relative to the first plurality of needles, and an actuator for selectively adjusting a spacing between the first needle bed and the second needle bed. The actuator may comprise a motor. Or, the actuator may comprises a manual input. The actuator may be configured to rotate at least one of the first needle bed and/or the second needle bed. Or, the actuator may be configured to move at least one of the first needle bed and/or the second needle bed. The knitting machine may also a first carriage associated with the first needle bed for actuating the first plurality of needles, and a second carriage associated with the second needle bed for actuating the second plurality of needles, wherein the first carriage is separate from the second carriage. Alternatively, the knitting machine may comprising a first carriage associated with the first needle bed for actuating the first plurality of needles, and a second carriage associated with the second needle bed for actuating the second plurality of needles, wherein the first carriage is operatively connected to the second carriage such that the first carriage is configured to move with movement of the first needle bed and/or the second carriage is configured to move with movement of the second needle bed. The spacing between the first needle bed and the second needle bed may be selectively adjustable between a distance of 5 mm and 15 mm. Additionally, the spacing between the first needle bed and the second needle bed may be selectively adjustable to a distance of 1 mm. Or, the spacing between the first needle bed and the second needle bed may be selectively adjustable to exceed a distance of 15 mm The present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

I claim:

1. A variable thickness knitted component formed on a knitting machine comprising a first needle bed and a second needle bed, the variable thickness knitted component comprising:

a first region comprising a double jersey knit structure comprising a first layer having a first plurality of loops formed on the first needle bed and a second layer having a second plurality of loops formed on the second needle bed; and a second region comprising a variable thickness spacer knit construction formed between the first layer and the second layer by interlocking a spacer yarn and varying a distance "d" between the first needle bed and the second needle bed following formation of each course.

2. The variable thickness knitted component of claim 1, wherein the variable thickness knitted component is an integral one-piece element.

3. The variable thickness knitted component of claim 1, wherein the first region comprises a first thickness, and wherein the second region comprises a second thickness that is different from the first thickness when viewed in a direction of a course of the variable thickness knitted component.

4. The variable thickness knitted component of claim 1, wherein the first region comprises a first thickness, and wherein the second region comprises a second thickness that is different from the first thickness when viewed in a direction of a wale of the variable thickness knitted component.

5. The variable thickness knitted component of claim 1, further comprising a third region also comprising the variable thickness spacer knit construction, wherein the third region and the second region are separated by the first region.

6. A variable thickness knitted component, comprising:

a first region comprising a first layer having a jersey knit structure and a second layer having the jersey knit structure, the first region having a first thickness; and a second region comprising a variable thickness spacer knit construction between the first layer and the second layer, the second region having a second variable thickness characterized by at least one spacer strand that is interlocked between the first layer and the second layer.

7. The variable thickness knitted component of claim 6, wherein the variable thickness knitted component is an integral one-piece element.

8. The variable thickness knitted component of claim 6, wherein the at least one spacer strand comprises a plurality of different lengths extending between the first layer and the second layer of the variable thickness spacer knit construction, the first surface being separate from the second surface, and wherein the plurality of different lengths define the second variable thickness.

9. The variable thickness knitted component of claim 6, wherein the second variable thickness varies when viewed in a direction of a course of the variable thickness knitted component.

10. The variable thickness knitted component of claim 6, wherein the second variable thickness varies when viewed in a direction of a wale of the variable thickness knitted component.

11. The variable thickness knitted component of claim 6, wherein the second variable thickness varies when viewed in a direction of a course and a direction of a wale of the variable thickness knitted component.

12. The variable thickness knitted component of claim 6, wherein the second variable thickness varies linearly.

13. The variable thickness knitted component of claim 6, wherein the second variable thickness varies non-linearly.

14. The variable thickness knitted component of claim 6, further comprising at least one inlaid strand extending through the second region.

15. The variable thickness knitted component of claim 14, wherein the inlaid strand is a cushioning yarn.

16. The variable thickness knitted component of claim 15, wherein the cushioning yarn is in a compressed state in the first region and in an expanded state in the second region comprising the variable thickness spacer knit construction.

17. The variable thickness knitted component of claim 6, wherein the at least one spacer strand comprises a first strand having a first color and a second strand having a second color different from the first color, and wherein at least one of the first surface layer or the second surface layer comprises a transparent material.

* * * * *